US011552424B2

(12) United States Patent
Su

(10) Patent No.: US 11,552,424 B2
(45) Date of Patent: Jan. 10, 2023

(54) ELECTRICAL CONNECTOR WITH DOUBLE-LAYER SHELLS AND STAGGERED SOLDERING LEGS

(71) Applicant: Advanced Connectek Inc., New Taipei (TW)

(72) Inventor: Wen-Hui Su, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 49 days.

(21) Appl. No.: 17/203,756

(22) Filed: Mar. 17, 2021

(65) Prior Publication Data

US 2021/0296812 A1 Sep. 23, 2021

(30) Foreign Application Priority Data

Mar. 18, 2020 (TW) ..... 109203062

(51) Int. Cl.

| | |
|---|---|
| ***H01R 13/516*** | (2006.01) |
| ***H01R 13/405*** | (2006.01) |
| ***H01R 43/20*** | (2006.01) |
| ***H01R 24/60*** | (2011.01) |
| ***H01R 43/02*** | (2006.01) |
| ***H01R 13/502*** | (2006.01) |

(52) U.S. Cl.

CPC ..... *H01R 13/516* (2013.01); *H01R 13/405* (2013.01); *H01R 13/502* (2013.01); *H01R 24/60* (2013.01); *H01R 43/02* (2013.01); *H01R 43/20* (2013.01)

(58) Field of Classification Search

CPC .. H01R 12/724; H01R 13/405; H01R 13/502; H01R 13/506; H01R 13/516; H01R 13/6581; H01R 13/6585; H01R 13/6593; H01R 13/6594; H01R 24/60; H01R 43/02; H01R 2107/00

See application file for complete search history.

(56) References Cited

U.S. PATENT DOCUMENTS

| | | | | |
|---|---|---|---|---|
| 7,097,504 | B2 * | 8/2006 | Kan | H01R 12/00 439/752 |
| 8,262,414 | B1 * | 9/2012 | Li | H01R 13/6273 439/607.37 |
| 8,435,075 | B2 * | 5/2013 | Lim | H01R 12/7047 439/607.35 |
| 8,535,097 | B2 * | 9/2013 | Yen | H01R 13/6594 439/607.4 |
| 9,660,399 | B2 * | 5/2017 | Hsu | H01R 13/6594 |
| 10,305,227 | B2 * | 5/2019 | Wang | H05K 5/04 |

* cited by examiner

*Primary Examiner* — Oscar C Jimenez
(74) *Attorney, Agent, or Firm* — JCIPRNET

(57) ABSTRACT

An electrical connector including an insulating body, a plurality of terminals disposed in the insulating body, a first shell sheathing the insulating body to form an insertion space for connecting to another electrical connector, and a second shell superposed on the first shell is provided. The first shell has at least one first soldering leg adjacent to the insertion space, and the second shell has at least one second soldering leg away from the insertion space.

19 Claims, 5 Drawing Sheets

ELECTRICAL CONNECTOR WITH DOUBLE-LAYER SHELLS AND STAGGERED SOLDERING LEGS

CROSS-REFERENCE TO RELATED APPLICATION

This application claims the priority benefit of Taiwan application serial no. 109203062, filed on Mar. 18, 2020. The entirety of the above-mentioned patent application is hereby incorporated by reference herein and made a part of this specification.

BACKGROUND

Technical Field

The present invention relates to an electrical connector.

Description of Related Art

As the amount of data transmitted between electronic devices continuously increases, in order to provide users with a more user-friendly experience, the speed of transmitting signals between electronic devices increases. An electrical connector is an electronic signal communication bridge between different electronic devices, so it is frequently applied to various electronic devices with the above situation.

However, under the trend of downsizing electronic device bodies, the size of an electrical connector is required to be reduced. What follows is that it affects the structural stability of the electrical connector package on the circuit board, which is easy to gradually decrease as the number of times the electrical connector is used (connecting and plugging) increases.

Accordingly, how to effectively improve the structural strength of the electrical connector configured on the circuit board under the above-mentioned trend is a problem that people skilled in the art need to consider and solve.

SUMMARY

The present invention provides an electrical connector which improves the structural strength of the electrical connector by a double-layer shell structure and staggered soldering legs.

In an exemplary embodiment, the electrical connector includes an insulating body, a plurality of terminals, a first shell and a second shell. The terminals are disposed in the insulating body. The first shell is sheathed the insulating body to form an insertion space for connecting to another electrical connector. The first shell has at least one first soldering leg adjacent to the insertion space. The second shell is superposed on the first shell. The second shell has at least a second soldering leg away from the insertion space.

In an exemplary embodiment, the second shell has at least one depression, the first soldering leg extends and penetrates the depression to be exposed outside the second shell.

In an exemplary embodiment, the insulating body has a front side and a rear side opposite to each other and two lateral sides opposite to each other, the insertion space is located at the front side, and the depression, the first soldering leg and the second soldering leg are located on at least one of the two lateral sides.

In an exemplary embodiment, the electrical connector is adapted to be fixed on the circuit board by the first soldering leg and the second soldering leg.

In an exemplary embodiment, the electrical connector has a plug/unplug axis, a size of the second shell along the plug/unplug axis is smaller than a size of the first shell along the plug/unplug axis, the front side and the rear side are located on the plug/unplug axis.

In an exemplary embodiment, the part of the first shell having the first soldering leg is not covered by the second shell.

In an exemplary embodiment, the first shell and the second shell are metal housings.

In an exemplary embodiment, the electrical connector is an electrical receptacle connector.

In an exemplary embodiment, the first shell has a ring-shaped body and the first soldering leg extending from the ring-shaped body, and the second shell has a ⊓-shaped body and the second soldering leg extending from the ⊓-shaped body. The ring-shaped body is sheathed the insulating body, and the ⊓-shaped body is superposed on and locked the ring-shaped body.

In an exemplary embodiment, a stamped hollow portion is disposed between the first soldering leg and the ring-shaped body, the hollow portion faces away from the ⊓-shaped body.

In an exemplary embodiment, the first shell is locked at two opposite wings of the ⊓-shaped body.

In an exemplary embodiment, the first shell and the first soldering leg and the second shell and the second soldering leg form a double-layer shell and an internal and external staggered soldering leg configuration structure outside the insulation body.

Based on the above, in the electrical connector of the present exemplary embodiment, by disposing different levels of the first shell and the second shell in succession outside the insulating body, an insertion space for connecting to another electrical connector is formed and the first soldering leg of the first shell is disposed adjacent to the insertion space, and the second soldering leg of the second shell is disposed away from the insertion space. Therefore, a structural relationship via the first shell and the second shell being superposed to each other is formed and the structural strength of the electrical connector may be increased by the difference in the position of the soldering legs.

When the electrical connector with double-layer shell structure is connected to another electrical connector, the plug/unplug force applied by the user will affect the insulation body, the first shell and the second shell at the same time. When the first soldering leg of a first shell in the inner layer is adjacent to the insertion space, and the second soldering leg of the second shell on the outer layer is far away the insertion space, thereby forming a staggered structure, which effectively distributes the plug/unplug force, and improving the durability of electrical connectors.

DESCRIPTION OF THE EMBODIMENTS

Figure 1:
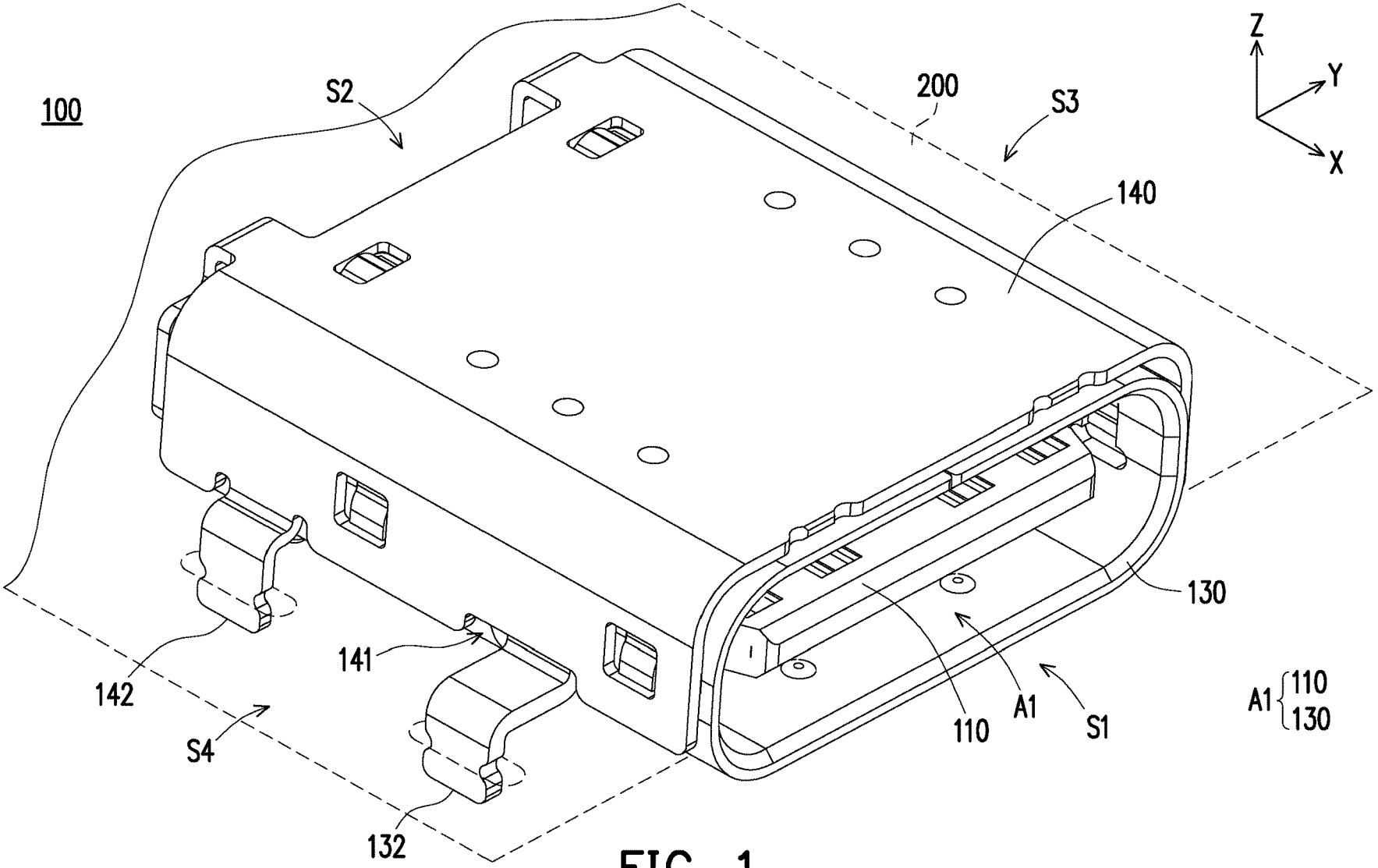
FIG. 1 is a schematic diagram of an electrical connector according to an exemplary embodiment.
Figure 2:
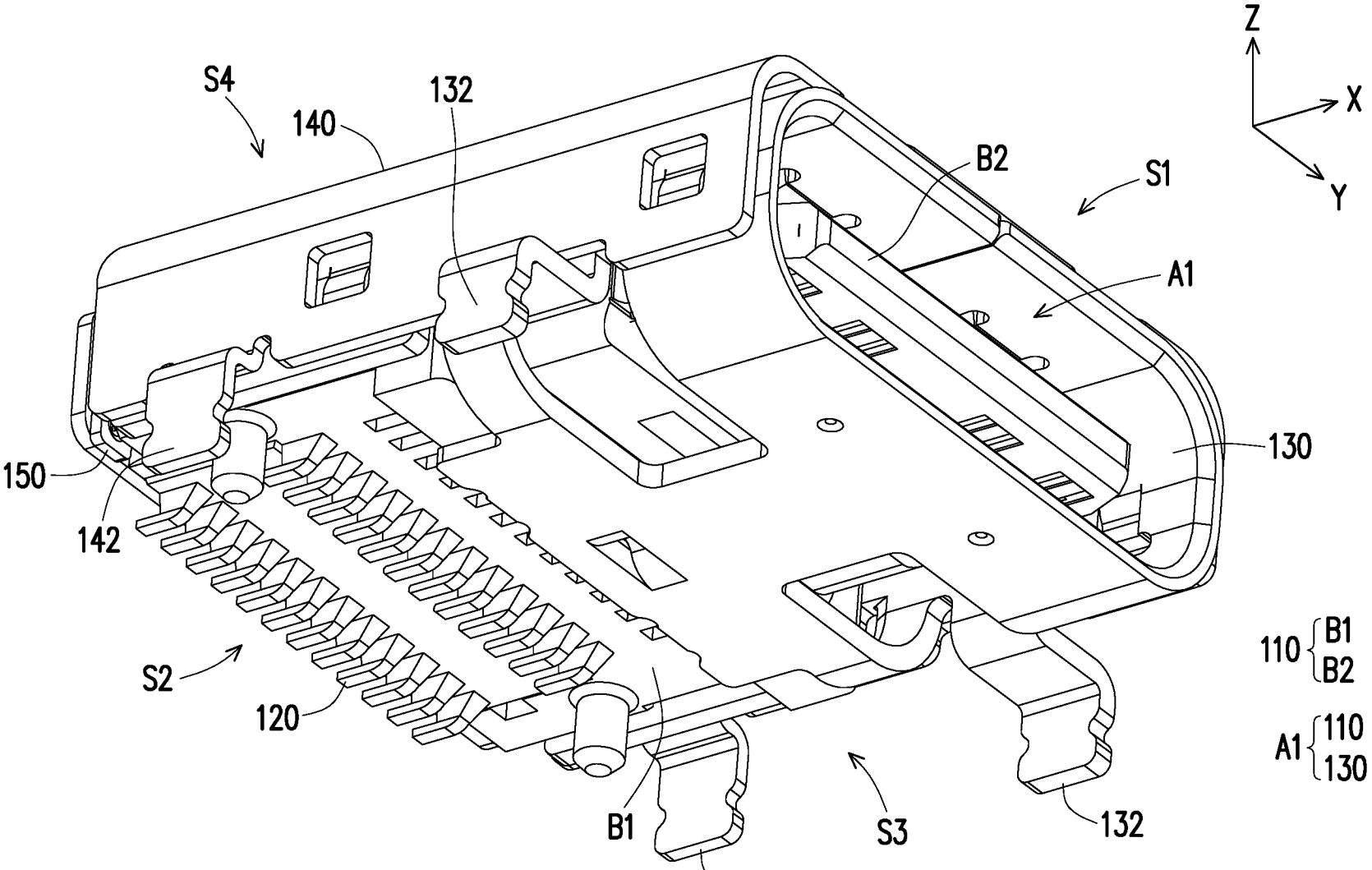
FIG. 2 illustrates the electrical connector of FIG. 1 from another perspective.

FIG. 1 is a schematic diagram of an electrical connector according to an exemplary embodiment. FIG. 2 illustrates the electrical connector of FIG. 1 from another perspective. Meanwhile, a rectangular coordinate X-Y-Z is provided for describing components. Referring to FIG. 1 and FIG. 2, in the present exemplary embodiment, the electrical connector 100 is, for example, a USB Type-C electrical connector, especially an electrical receptacle connector configured on the circuit board 200, which includes an insulating body 110, a plurality of terminals 120, a first (metallic) shell 130, and a second (metallic) shell 140. The terminals 120 are disposed in the insulating body 110. The first shell 130 is sheathed the insulating body 110, and the first shell 130 has at least one first soldering leg 132. The second shell 140 is superposed on the first shell 130. The insulating body 110 and the first shell 130 form an insertion space A1, and the insertion space A1 is suitable for docking with another electrical connector (not shown). The second shell 140 has at least one second soldering leg 142, wherein the first soldering leg 132 is adjacent to the insertion space A1, the second soldering leg 142 is away from the insertion space A1. That is, along the X-axis, the distance between the first soldering leg 132 and the insertion space A1 is less than the distance between the second soldering leg 142 and the insertion space A1.

In the exemplary embodiment, the insulating body 110 has a front side S1 and a rear side S2 opposite to each other, and two lateral sides S3 and S4 opposite to each other, wherein the insertion space A1 is located on the front side S1, and the first soldering leg 132 and the second soldering leg 142 are located on at least one of the lateral side S3 and the side S4. Herein, a case of disposing the first soldering leg 132 and the second soldering leg 142 on both the lateral sides S3 and S4 is taken as an example. As shown in FIG. 1 and FIG. 2, the first shell 130 has a plurality of first soldering legs 132, which are located on opposite sides of the insertion space A1 along the Y-axis. Similarly, the second shell 140 has a plurality of second soldering legs 142, located on opposite sides of the insertion space A1 along the Y-axis. As shown in FIG. 1, the electrical connector 100 is adapted to be fixed on the circuit board 200 by the first soldering legs 132 and the second soldering legs 142. Furthermore, the first shell 130 and the second shell 140 are metal shells, which may maintain the structural strength required by the electrical connector 100 and also be electrically connected to the grounding circuit of the circuit board 200, thereby providing the required grounding effect during the connection with another electrical connector. Furthermore, in the process of docking the electrical connector 100 and another electrical connector, the front side S1 and the rear side S2 are substantially located on the plug/unplug axis (i.e., the X-axis), while the side sides S3 and S4 are located on the opposite sides of the plug/unplug axis.

Figure 3:
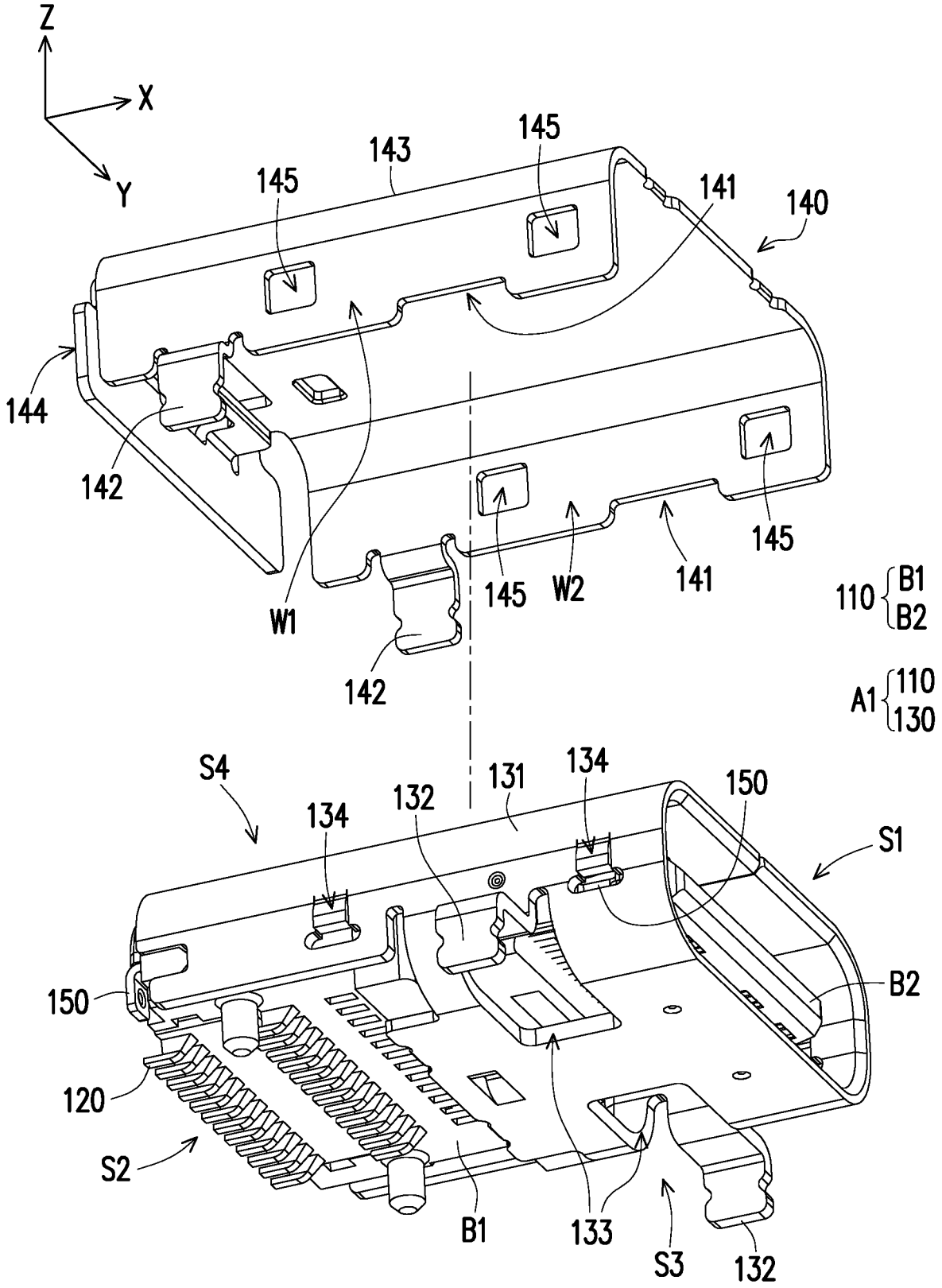
FIG. 3 is a partial exploded view of the electrical connector of FIG. 2.
Figure 4:
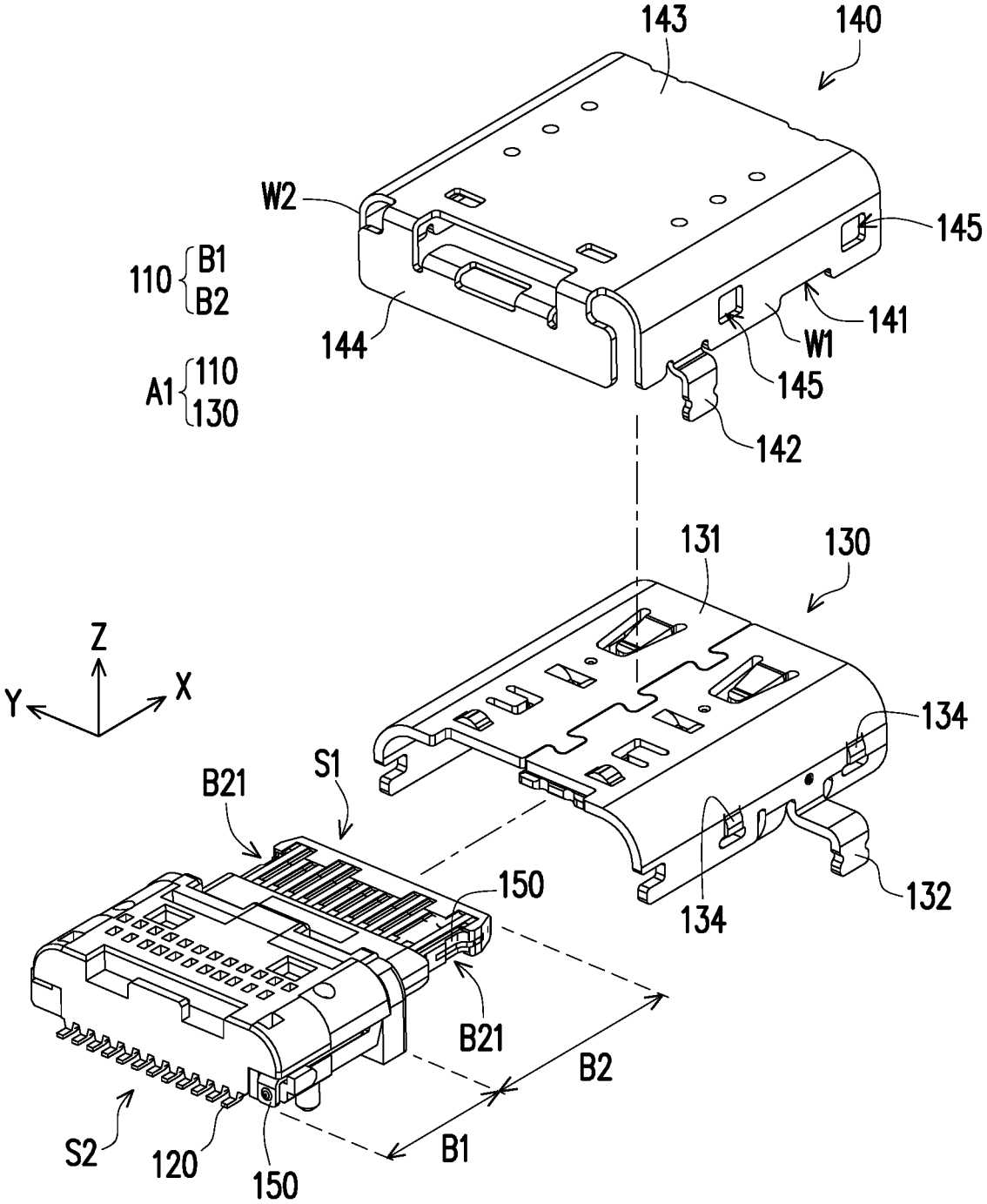
FIG. 4 is another exploded view of the electrical connector of FIG. 2.

FIG. 3 is a partial exploded view of the electrical connector of FIG. 2, wherein the structures not marked in FIGS. 1 and 2 are marked in detail in FIG. 3. FIG. 4 is another exploded view of the electrical connector of FIG. 2, which could be shown the first shell 130 being removed from the insulating body 110. Referring to FIGS. 3 and 4, the first shell 130 has a ring-shaped body 131 and first soldering legs 132 extending from the ring-shaped body 131, the second shell 140 has a ⊓-shaped body 143 and second soldering legs 142 extending from the ⊓-shaped body 143, the ring-shaped body 131 is sheathed the insulating body 110, and the ⊓-shaped body 143 is superposed on and locked the ring-shaped body 131. The second shell 140 has a depression 141, which is used to allow the first soldering legs 132 of the first shell 130 to extend and penetrate the depression 141 to be exposed outside the second shell 140.

Herein, the first shell 130 has a plurality of locking structures 134, and the second shell 140 also has a plurality of locking structures 145 to correspond to the locking structures 134, and the locking structures 145 and the depression 141, the second soldering legs 142 are located on the opposite side wings W1 and W2 of the ⊓-shaped body 143. When the second shell 140 is superposed on and covers the first shell 130, the first shell 130 is locked on the opposite side wings W1 and W2 of the ⊓-shaped body 143 by the docking of the locking structures 134 and 145, thereby achieving the effect of fixing the first shell 130 and the second shell 140 together. At the same time, because the first soldering legs 132 and the second soldering legs 142 are respectively fixed to the circuit board 200 (as shown in FIG. 1), the combination strength of the first shell 130, the second shell 140 and the circuit board 200 may can be more ensured. Additionally, for the second shell 140, a rear cover 144 extends from the ⊓-shaped body 143 toward the negative X-axis direction and bends to abut the opposite side of the insulating body 110 away from the insertion space A1.

Referring to FIGS. 3 and 4 again, the insulating body 110 comprises a base portion B1 and a tongue portion B2 extending from the base portion B1, wherein two side edges of the tongue portion B2 respectively has a depressed space B21, the terminals 120 are partially exposed from two tongue surfaces of the base portion B1. The electrical connector 100 further comprises a metallic plate 150 disposed in the insulating body 110, wherein two side edges of the metallic plate 150 are respectively and exposed on the depressed spaces B21 of the two side edges of the tongue portion B2.

Additionally, for the first shell 130, the first soldering legs 132 are formed by stamping and bending the ring-shaped body 131 that has not been formed (which is plate-shaped), and thus a stamped hollow portion 133 is formed between the ring-shaped body 131 that has been formed and the first soldering legs 132, wherein the hollow portion 133 faces away from the ⊓-shaped body 143 of the second shell 140.

Based on the above, the first shell 130 and the second shell 140 form a double-layer shell structure outside the insulating body 110 to provide the structural appearance and structural strength required by the electrical connector 100. Furthermore, the first soldering leg 132 and the second soldering leg 142 further constitute the staggered soldering leg structure of the electrical connector 100, which is beneficial to allow the first shell 130 and the second shell 140 to be fixed with the circuit board 200, such that an interconnected structure between the first shell 130, the second shell 140 and the circuit board 200 may be formed, thereby further increasing the structural strength of the electrical connector 100.

Figure 5:
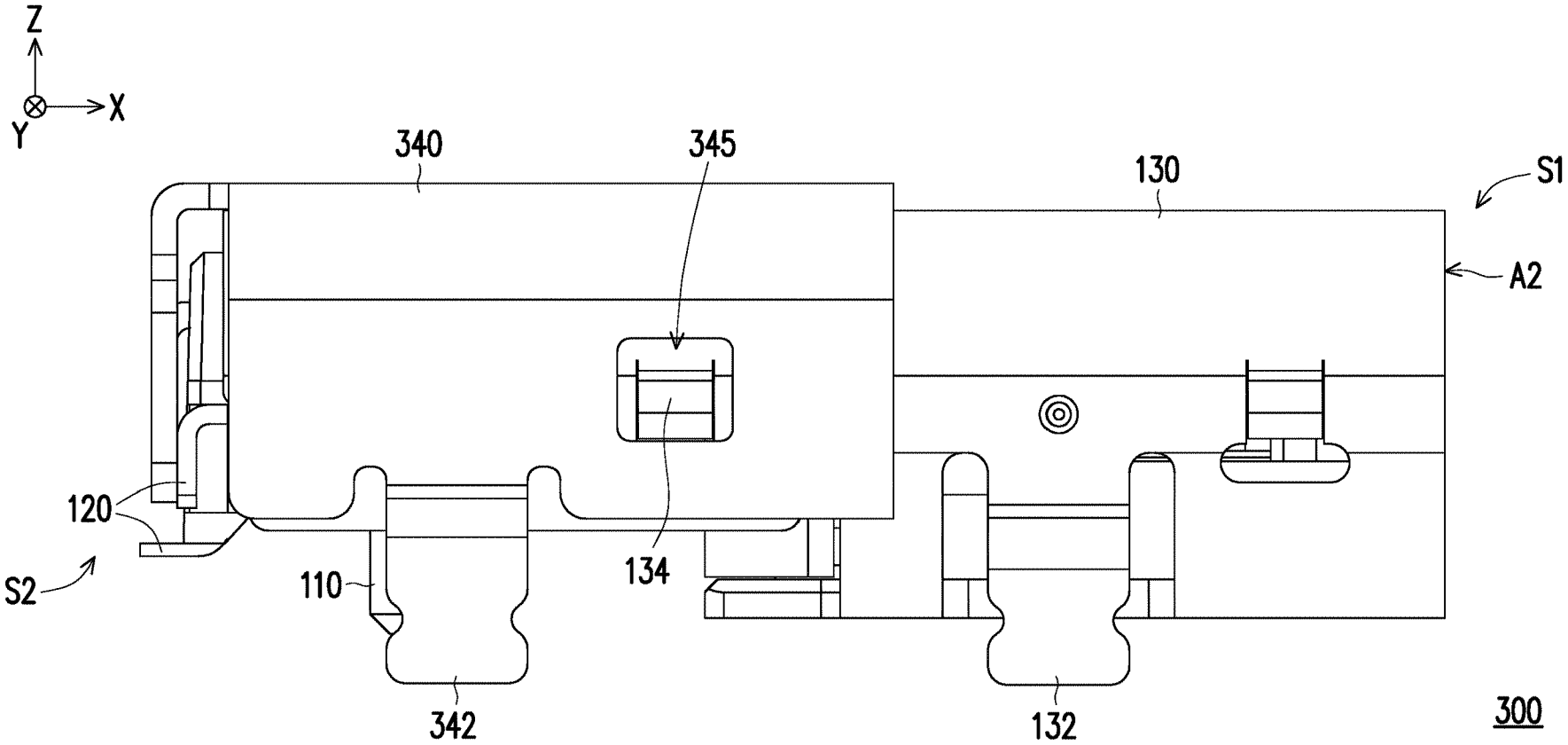
FIG. 5 is a side view of the electrical connector according to another exemplary embodiment.

FIG. 5 is a side view of the electrical connector according to another exemplary embodiment. Referring to FIG. 5, in the electrical connector 300 of the present exemplary embodiment, the first shell 130 is the same as that in the above embodiment, so the description will not be repeated. The difference is that the size of the second shell 340 along the plug/unplug axis of the electrical connector 300 (i.e., the X-axis) is smaller than the size of the first shell 130 along the plug/unplug axis, and similarly, the front side S1 and the rear side S2 are located on the plug/unplug axis. That is, the portion of the first shell 130 having the first soldering legs 132 is not directly covered by the second shell 340 and is directly exposed to the outside. The first shell 130 and the second shell 340 are locked together only by the locking structures 134 and 345. However, the same thing is that the second soldering legs 342 of the second shell 340 still are away from the insertion space A2, and the first soldering legs 132 of the first shell 130 still are adjacent to the insertion space A2, and therefore the effect of strengthening the structure mentioned in the above exemplary embodiment may be achieved.

In summary, in the electrical connector of the present exemplary embodiment, by disposing different levels of the first shell and the second shell in succession outside the insulating body, an insertion space for connecting to another electrical connector is formed and the first soldering leg of the first shell is disposed adjacent to the insertion space, and the second soldering leg of the second shell is disposed away from the insertion space. Therefore, a structural relationship via the first shell and the second shell being superposed to each other is formed and the structural strength of the electrical connector may be increased by the difference in the position of the soldering legs.

Accordingly, the first shell and the second shell form a double-layer shell structure outside the insulating body, and the first soldering legs and the second soldering legs further constitute the staggered soldering leg structure of the electrical connector. This is beneficial to allow the first shell 130 and the second shell 140 to be fixed with the circuit board 200, such that an interconnected structure between the first shell 130, the second shell 140 and the circuit board 200 may be formed, thereby further increasing the structural strength of the electrical connector 100.

When the electrical connector is connected with another electrical connector, the plug/unplug force applied by the user will affect the insulation body, the first shell and the second shell at the same time. However, by the configuration of the above shells and the above soldering legs, the plug/unplug force may be effectively distributed and the durability of electrical connectors is improved.

What is claimed is:

1. An electrical connector comprising: an insulating body; a plurality of terminals, disposed in the insulating body; a first shell, sheathing the insulating body to form an insertion space for connecting to another electrical connector, wherein the first shell has at least one first soldering leg, and the first soldering leg extends outward and is adjacent to a forward opening of the insertion space; and a second shell, superposed on a top surface of the first shell, wherein the second shell has at least one second soldering leg, the second soldering leg is rearward and away from the opening of the insertion space, and the at least one first soldering leg is not covered by the second shell.

2. The electrical connector according to claim 1, wherein the second shell has at least one depression, and the first soldering leg extends and penetrates the depression to be exposed outside the second shell.

3. The electrical connector according to claim 2, wherein the insulating body has a front side and a rear side opposite to each other, and two lateral sides opposite to each other, the opening of the insertion space is located on the front side, and the depression, the first soldering leg and the second soldering leg are located on at least one of the two lateral sides.

4. The electrical connector according to claim 3, wherein the electrical connector has a plug/unplug axis, and a size of the second shell along the plug/unplug axis is smaller than a size of the first shell along the plug/unplug axis, and the front side and the rear side are located on the plug/unplug axis.

5. The electrical connector according to claim 4, wherein a part of the first shell having the first soldering leg is not covered by the second shell.

6. The electrical connector according to claim 1, wherein the first shell and the second shell are metallic shells.

7. The electrical connector according to claim 1, wherein the first shell has a ring-shaped body and the first soldering leg extending from the ring-shaped body, and the second shell has a ⊓-shaped body and the second soldering leg extending from the ⊓-shaped body, the ring-shaped body is sheathing the insulating body, the ⊓-shaped body is superposed on and locked the ring-shaped body.

8. The electrical connector according to claim 7, wherein a stamped hollow portion is disposed between the first soldering leg and the ring-shaped body, and the hollow portion faces away from the ⊓-shaped body.

9. The electrical connector according to claim 7, wherein the first shell is locked at two opposite wings of the ⊓-shaped body.

10. The electrical connector according to claim 1, wherein the first shell and the first soldering leg and the second shell and the second soldering leg constitute a double-layer shell and an internal and external staggered soldering leg configuration structure outside the insulation body.

11. An electrical connector comprising: an insulating body comprising a base portion and a tongue portion, wherein two side edges of the tongue portion respectively has a depressed space; a plurality of terminals, disposed in the insulating body and partially exposed from two tongue surfaces of the tongue portion; a metallic plate disposed in the insulating body, wherein two side edges of the metallic plate are respectively and exposed on the depressed spaces of the two side edges of the tongue portion; a first metallic shell, sheathing the insulating body to form an insertion space, wherein the first metallic shell has at least one first soldering leg, and the first soldering leg extends outward and is adjacent to a forward opening of the insertion space; and a second metallic shell, superposed on a top surface of the first metallic shell, wherein the second metallic shell has at least one second soldering leg, the second soldering leg is rearward and away from the opening of the insertion space, and the at least one first soldering leg is not covered by the second metallic shell.

12. The electrical connector according to claim 11, wherein the second metallic shell has at least one depression, and the first soldering leg extends and penetrates the depression to be exposed outside the second metallic shell.

13. The electrical connector according to claim 12, wherein the insulating body has a front side and a rear side opposite to each other, and two lateral sides opposite to each other, the insertion space is located on the front side, and the depression, the first soldering leg and the second soldering leg are located on at least one of the two lateral sides.

14. The electrical connector according to claim 11, wherein the electrical connector has a plug/unplug axis, and a size of the second metallic shell along the plug/unplug axis is smaller than a size of the first shell along the plug/unplug axis, and the front side and the rear side are located on the plug/unplug axis.

15. The electrical connector according to claim 14, wherein a part of the first metallic shell having the first soldering leg is not covered by the second metallic shell.

16. The electrical connector according to claim 11, wherein the electrical connector is an electrical receptacle connector.

17. The electrical connector according to claim 11, wherein the first metallic shell has a ring-shaped body and the first soldering leg extending from the ring-shaped body, and the second shell has a ⊓-shaped body and the second soldering leg extending from the ⊓-shaped body, the ring-shaped body is sheathing the insulating body, the ⊓-shaped body is superposed on and locked the ring-shaped body.

18. The electrical connector according to claim 17, wherein a stamped hollow portion is disposed between the first soldering leg and the ring-shaped body, and the hollow portion faces away from the ⊓-shaped body.

19. The electrical connector according to claim 17, wherein the first metallic shell is locked at two opposite wings of the ⊓-shaped body.

* * * * *